United States Patent [19]

Risi

[11] 4,048,795

[45] Sept. 20, 1977

[54] TIMEPIECE CALENDAR MECHANISM

[75] Inventor: René Risi, Berne, Switzerland

[73] Assignee: Bulova Watch Company, Inc., Flushing, N.Y.

[21] Appl. No.: 628,470

[22] Filed: Nov. 4, 1975

[30] Foreign Application Priority Data

Nov. 6, 1974 Switzerland ..... 14824/74

[51] Int. Cl.[2] ..... G04B 19/24

[52] U.S. Cl. ..... 58/4 R; 58/5; 58/58

[58] Field of Search ..... 58/4 R, 5, 58

[56] References Cited

U.S. PATENT DOCUMENTS

| | | | |
|---|---|---|---|
| 3,451,211 | 6/1969 | Nakagawa | 58/58 |
| 3,527,047 | 9/1970 | Bolle | 58/58 |

*Primary Examiner*—Stanley J. Witkowski

[57] ABSTRACT

A timepiece calendar mechanism which includes a monthly date ring having a circular set of internal teeth and a day-of-the-week disc disposed within the interior space of the date ring and concentric therewith, the day disc having a circular set of external gear teeth. Pivotally mounted between the two sets of gear teeth is a twin jumper having oppositely-directed arms whose free ends are provided with detents which respectively engage the sets of teeth.

4 Claims, 1 Drawing Figure

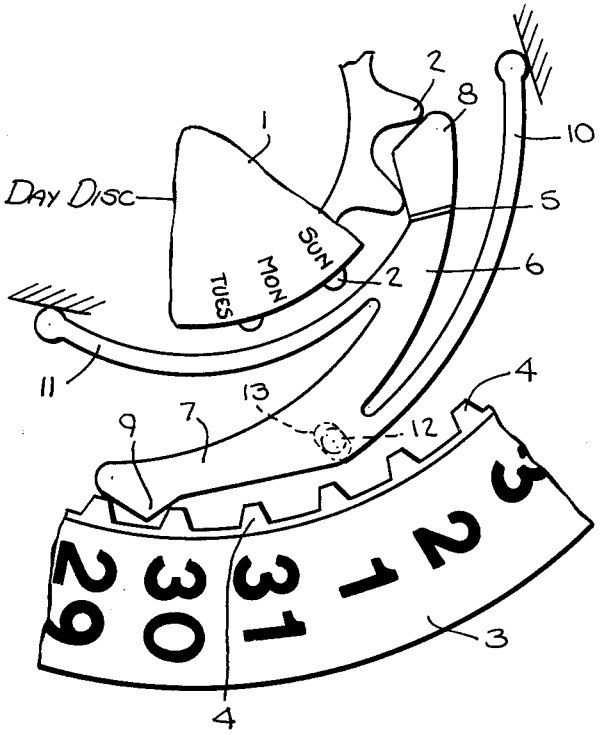
DAY DISC
SUN
MON
TUES
1
2
3
4
5
6
7
8
9
10
11
12
13
29
30
31
1
2
3

TIMEPIECE CALENDAR MECHANISM

BACKGROUND OF INVENTION

This invention relates generally to timepiece calendar mechanisms, and more particularly to a twin jumper adapted to detent the movement of concentrically-arranged day and date indicating elements.

As used herein, the term "date ring" refers to a ring having numerals printed thereon in a circular array to indicate the monthly date (1 to 31). The term "day disc" refers to a disc having a circular array of letters or symbols thereon representing the days of the week (MON to SUN). In practice, the day-indicating element may be in ring form.

In one known type of calendar mechanism, a date ring is provided with a set of internal gear teeth, while a concentrically-disposed day disc is provided with a set of external gear teeth. The two sets of teeth are engaged by driven operating means which cause the date ring and the day disc to present date and day readings. In a mechanism of this known type, use is made of a jumper consisting of two resilient arms which merge at a pivotally-mounted hub, the arm extending outwardly from the hub at acute angles, whereby detents at the free ends of the arms engage the teeth of the day and date indicating elements.

A drawback of this prior arrangement resides in the difficulties experienced in assembly when placing the day disc in position. Because this disc covers the set of external gear teeth lying underneath it and the jumper arm associated with this set, which arm is under spring tension, the disc obstructs the entry of the detent of this arm into a gap between two gear teeth. In order, therefore, to facilitate assembly operations, it was heretofore the practice to provide a small window in the day disc giving access to a fine tool for lifting the resilient jumper arm during this critical phase of assembly.

This expedient is not satisfactory, for upon lifting one jumper arm to clear the gear teeth, the pressure then exerted by the other jumper arm is increased. As a consequence, the simultaneous actuation of the date ring and the day disc is seriously impaired.

SUMMARY OF INVENTION

In view of the foregoing, the main object of this invention is to overcome the disadvantages characteristic of existing types of jumpers and to provide an improved form of twin jumper having the following distinctive features:

A. The jumper is constructed as a two-armed lever whose arms are bent or angled in the same direction as the gear teeth sections adjacent thereto.

B. One detent is disposed at the free end of one arm and the other detent is disposed on the opposite side of the jumper on the free end of the other arm.

C. The jumper is pivoted between the two detents, and is so pivoted as to permit a limited degree of shift.

OUTLINE OF DRAWING

For a better understanding of the invention as well as other objects and further features thereof, reference is made to the drawing whose single FIGURE is a plan view of a preferred embodiment of a twin jumper for a calendar mechanism having a date ring and a day disc.

DESCRIPTION OF INVENTION

As illustrated in the FIGURE, the day disc 1, whose periphery is indicated by dashed lines is provided at its underside with a set 2 of external gear teeth in a circular array. The disc is fixedly attached to the set of gear teeth and covers the major portion thereof. Set 2 has 14 teeth, so that the day disc undergoes a full revolution in two weeks. Date ring 3 is conventional and is provided with a set 4 of internal gear teeth in a circular array, there being 31 teeth, one for each day of the month.

The gear teeth set 2 and the gear teeth set 4 are concentrically arranged, and pivotally mounted therebetween is a double-acting, twin jumper preferably made of synthetic plastic material. The jumper is constructed as a two-armed lever comprising an arm 6 which at point 5 is cranked to compensate for the difference in the levels between the two sets of teeth. A detent 8 is formed at the free end of arm 6, the detent cooperating with the teeth of set 2.

Further included in the jumper is an arm 7 having a detent 9 formed at the free end thereof, detent 9 cooperating with the teeth of set 4. Integral with lever arms 6 and 7 are two bendable springs 10 and 11 whose free ends rest against fixed parts. These bias springs hold the jumper and, accordingly, the date ring and day disc in their appropriate positions.

Finally, the jumper includes a pin 12, only indicated generally, which is guided in a slot 13 formed in a base plate, slot 13 extending approximately in the radial direction so that the pivoting center of the jumper can be shifted to some degree with respect to the other parts. Conversely, the base plate may be provided with a fixed pin projecting into a slot formed in the jumper.

The two-armed lever is so bent or curved that its pivot pin 12 is located as closely as possible to the teeth of set 4 of the date ring. The two jumper arms 6 and 7 and their detents 8 and 9 in this arrangement each extend almost tangentially with respect to the teeth in sets 2 and 4. The detents 8 and 9, therefore, each perform a movement which is at least approximately radial, whereby the detents ride over the teeth and one obtains a satisfactory degree of friction. In lieu of an integral spring, one may provide a tensioning spring which is not directly attached to its associated lever arm, but only lies against it.

The placement of the day-of-the-week disc carrying teeth 2 can now be carried out very simply. At the outset, it is only necessary to seat this disc in position provisionally, after which date ring 3 is turned until detent 9 strikes a tooth in set 4. This results in clearing detent 8 of arm 6 so that the day disc then immediately drops into its desired position or after a slight turning of the parts.

The construction of a jumper in accordance with the invention is also advantageous if detent 8 should slide laterally off a tooth in set 2. In this instance, it is no longer necessary to open up the timepiece or watch for repair, and it is sufficient to turn the date ring so that the slipped detent is automatically raised back to its original level.

Because of the play in the radial direction between slot 13 and pin 12, this gives rise to another advantage, in that the even pressure distribution of detents 8 and 9 on teeth sets 2 and 4 is not disturbed by any small departure in dimensions.

While there has been shown and described a preferred embodiment of a timepiece calendar mechanism in accordance with the invention, it will be appreciated that many changes and modifications may be made therein without, however, departing from the essential spirit thereof.

I claim:

1. In a calendar mechanism for a timepiece, the combination comprising:

A. a date ring having a circular set of internal gear teeth;

B. a day disc disposed within the interior space of the date ring and concentric therewith, said day disc having a circular set of external gear teeth; and C. a double-acting twin jumper pivotally mounted between the two sets of teeth, the pivot of said jumper allowing for a limited degree of shifting movement, said jumper being formed by two oppositely-directed lever arms extending from either side of said pivot, each arm having a detent at the free end thereof engaging a respective set of teeth and being angled in the same direction as the section of teeth in the set adjacent thereto, each arm having integral therewith a biasing spring whose free end rests against a fixed element to maintain the position of said jumper between said two sets of teeth.

2. A calendar mechanism as set forth in claim 1, wherein the detents clear the teeth of the sets associated therewith in an approximately radial direction.

3. A calender mechanism as set forth in claim 1, wherein the shiftable pivot of said jumper is formed by a pin on said jumper which is received within a slot which extends in an approximately radial direction.

4. A calendar mechanism as set forth in claim 1, wherein said jumper is fabricated of synthetic plastic material.

* * * * *